United States Patent [19]

Blount et al.

[11] Patent Number: 4,706,648

[45] Date of Patent: Nov. 17, 1987

[54] ASH CATCHER FOR FIREPLACE INSERT

[76] Inventors: Emmitt Blount, 103 South St.; Edward L. Exum, 202 Phillips St.; Murthis E. Wooten, P.O. Box 105, all of LaGrange, N.C. 28551

[21] Appl. No.: 902,794

[22] Filed: Sep. 2, 1986

[51] Int. Cl.[4] ..... F23J 1/00

[52] U.S. Cl. ..... 126/243; 108/116; 108/132; 108/133; 110/166

[58] Field of Search ..... 126/242, 243; 110/166; 108/116, 133, 129, 132

[56] References Cited

U.S. PATENT DOCUMENTS 708,162 9/1902 O'Connor ..... 126/242

2,978,012 4/1961 Norseen ..... 108/116

3,709,159 1/1973 Oglesby ..... 108/129

*Primary Examiner*—Carroll B. Dority, Jr.

*Attorney, Agent, or Firm*—Mills & Coats

[57] ABSTRACT

The invention herein relates to ash catchers for woodstoves of the type adapted to be inserted into an existing fireplace. The ash catcher includes a generally horizontal pan supported along the front edge by a pair of fixed legs. A third leg is pivotally secured to the pan and is biased to a downward position for supporting the rear edge of said pan. When placed in a position for catching ashes from a woodstove, the rear leg is pivoted upwardly against the underside of the pan which rests upon the fireplace hearth.

9 Claims, 6 Drawing Figures

ASH CATCHER FOR FIREPLACE INSERT

FIELD OF THE INVENTION

The present invention relates generally to accessories for fireplaces and stoves and more particularly to ash pans for removing and disposing of ash.

BACKGROUND OF THE INVENTION

The use of woodstoves for space heating is centuries old. Yet, with the increased costs of operating gas, oil and electric heating systems, the woodstove remains a viable alternative for home space heating. One drawback to woodstoves, however, is the need to periodically remove and dispose of ash.

To facilitate removal and disposal of ash, ash pans have been designed which may be positioned with respect to the woodstove such that ash may be swept therefrom without spilling the same in the area adjacent the stove. One such ash pan is disclosed in the patent to Conner, U.S. Pat. No. 708,162 which is particularly designed for use with a freestanding woodstove. The ash pan of Conner, however, is not well suited for removing ash from woodstoves of the type to be inserted into an existing fireplace.

SUMMARY AND OBJECTS OF THE INVENTION

The present invention relates to ash catchers for woodstoves of the type adapted to be inserted into an existing fireplace, which typically includes a ledge extending outwardly over the fireplace hearth. The ash catcher includes a generally, horizontal pan which is supported along the front edge by a pair of fixed legs. A third leg is pivotally secured to the pan and biased to a downward position for supporting the rear of the pan. When placed in a position for catching ashes from the woodstove, the rear leg is folded against the underside of the pan which rests upon the fireplace hearth. The rear wall of the pan slides beneath the ledge of the woodstove. The overhang of the ledge minimizes the amount of ash which may be spilled when sweeping the stove.

Accordingly, it is an object of the present invention to provide a means for removing ash and other debris from an insert-type woodstove without spilling the same onto areas adjacent the woodstove.

Another object of the present invention is to provide an ash pan which can be supported by a fireplace hearth with one edge extending underneath the ledge typically found on insert-type woodstoves when in use and can be self-supported when not in use.

Another object of the present invention is to achieve the foregoing object by providing said ash pan with a pivotally secured leg which can be folded against the underside of said ash pan when the same is rested upon the fireplace hearth, but which automatically assumes a downward, substantially vertical position when said ash pan is removed.

Another object of the present invention is to provide an ash pan which is relatively simple in construction and inexpensive to manufacture.

Another object of the present invention is to provide an ash pan which will be attractive in appearance and which may be used decoratively.

Other objects and advantages of the present invention will become apparent and obvious from a study of the following description and the accompanying drawings which are merely illustrative of such invention.

DETAILED DESCRIPTION OF THE INVENTION

Figure 1:
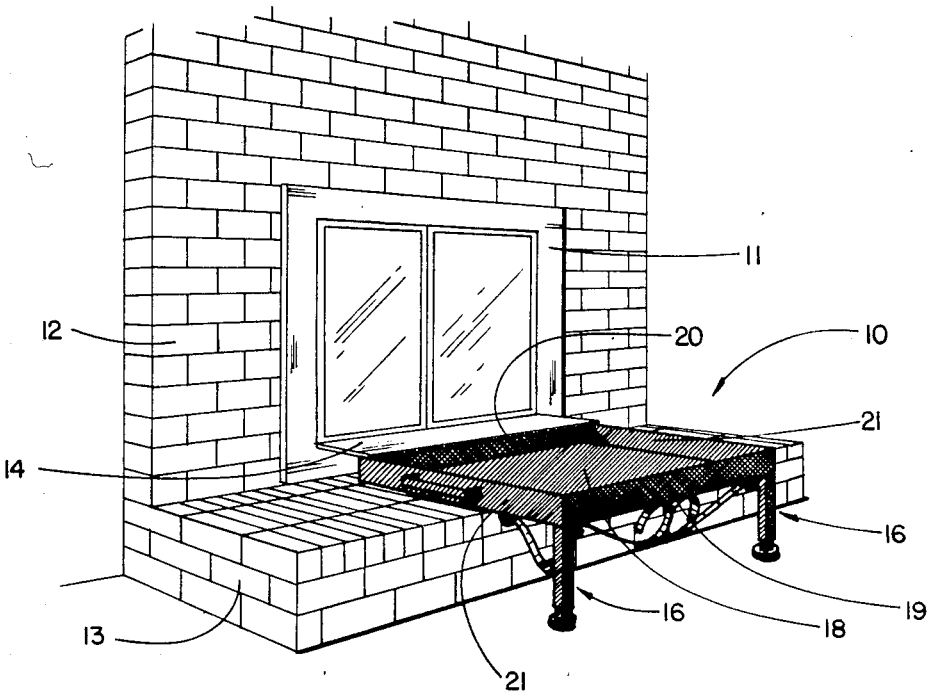
FIG. 1 is a front perspective view of the ash catcher of the present invention.
Figure 2:
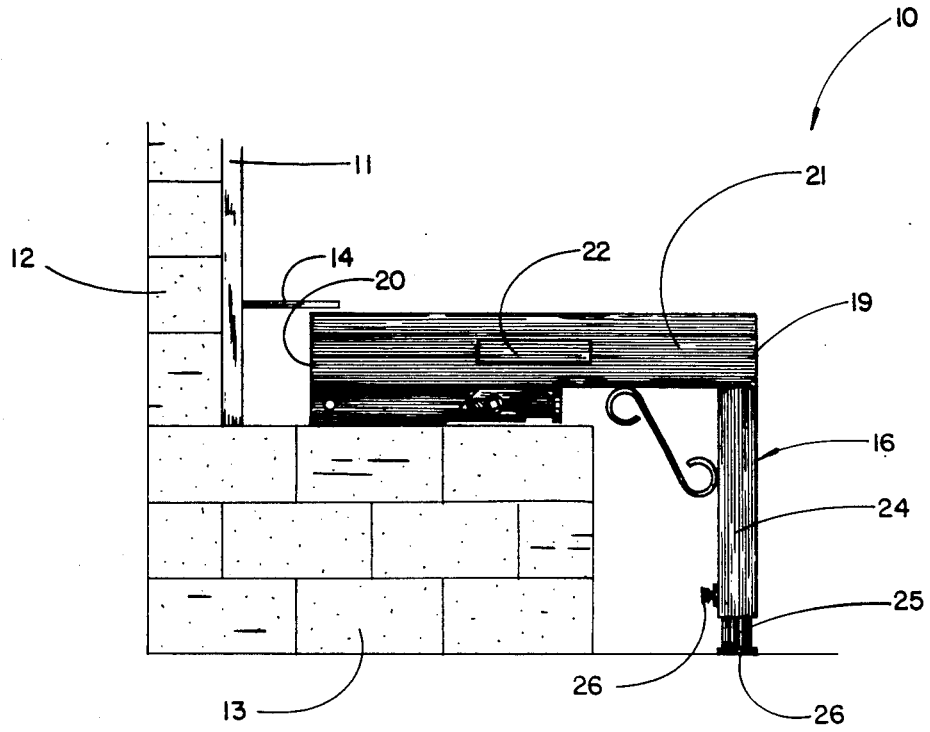
FIG. 2 is a side elevational view thereof showing the rear leg in an upward, inoperative position.

Referring now to the drawings, the ash catcher of the present invention is shown therein and indicated generally by the numeral 10. The ash catcher 10 is designed to be used in connection with a woodstove 11 of the type adapted to be inserted into a fireplace 12. Since woodstoves and fireplaces are well known to those skilled in the art, a detailed discussion of the same is not deemed necessary. However, it is noted that in order to practice the invention claimed herein, the fireplace must be of the type having a raised hearth 13 as is clearaly illustrated in FIG. 1. The woodstove 11 in connection with which the present invention is used typically includes a ledge 14 which is best illustrated in FIG. 2, but such is not necessary.

Turning now to the ash catcher 10, it is seen that the same includes an ash pan indicated generally at 15, a pair of front legs indicated generally at 16 for supporting the front of the ash pan 15, and a rear folding leg indicated generally at 17 for supporting the rear of the ash pan 15.

The ash pan 15 includes a bottom 18 and a surrounding wall structure consisting of a front wall 19, a rear wall 20 and side walls 21. A pair of U-shaped handles 22 are secured to opposite side walls 21 to provide means for lifting and carrying the ash catcher and to facilitate removal of ashes contained therein. A downwardly opening channel number 23 is secured underneath the bottom 18 of ash pan 15 midway between side walls 21 and extends perpendicularly from the rear wall 19 toward the front wall 20. The walls of the channel member 23 define a receiving area into which the rear leg 17 is folded as will be described in detail below.

The front legs 16 include an upper leg portion 24 secured to the underside of ash pan at respective front corners. A pair of telescoping, lower leg portions 25 having feet 26 are slidingly mounted within corresponding upper leg portions 24 and can be fixed at any desired position by tightening set screw 27 so as to bear against lower leg portion 25. Because of the danger of spilling hot ashes on carpet or other flammable materials, it is preferred that the upper leg portions 24 be fixedly secured to the bottom 18 of ash pan 15 to prevent inadvertent collapsing of the ash pan 15 while in use.

Figure 4:
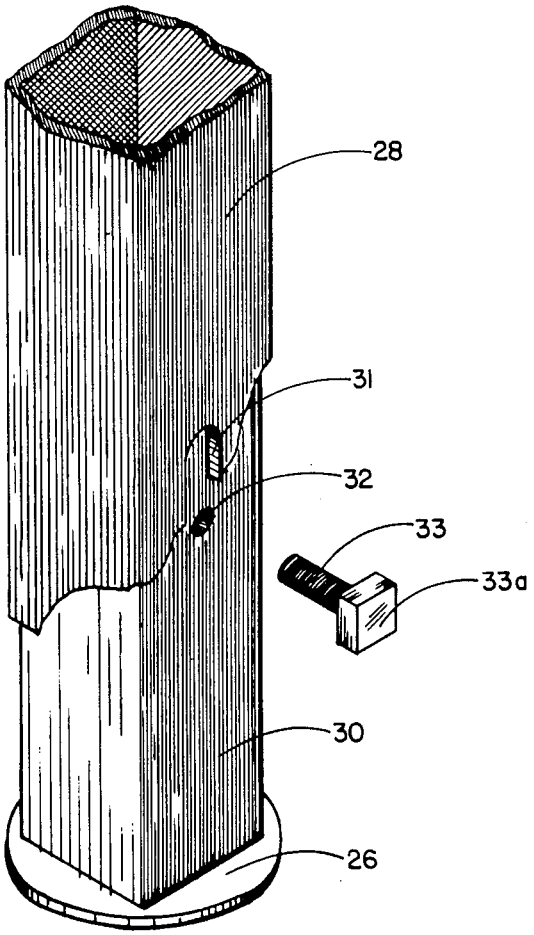
FIG. 4 is a detailed perspective view of the rear leg thereof.
Figure 5:
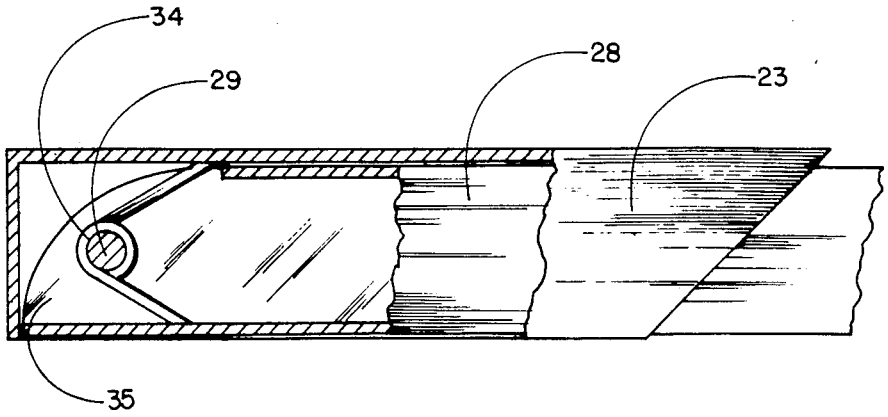
FIG. 5 is a side sectional view thereof with the rear leg in an upward, inoperative position.

The rear leg 17 also includes an upper leg portion 28 which unlike front legs 16 is pivotally secured to the channel member 23 by means of a pivot pin 29. A telescoping, lower leg portion 30 is slidingly mounted within upper leg portion 28 as can be best seen in FIG. 4. In order to adjust the length of rear leg 17, the upper leg portion 28 is provided with a slot 31 while lower leg portion 30 includes a threaded hole 32 which aligns with slot 31 when the lower leg portion 30 is inserted properly. An adjusting screw 33 extends through slot 31 and is threaded into hole 32 until the head 33*a* of screw 33 bears against the surface of upper leg portion 30. To adjust the length of rear leg 17, screw 32 is loosened so that lower leg portion 30 can be slid with respect to upper leg portion 28. When the desired length is attained, screw 32 is then retightened to fix lower leg portion 30 in place.

Figure 3:
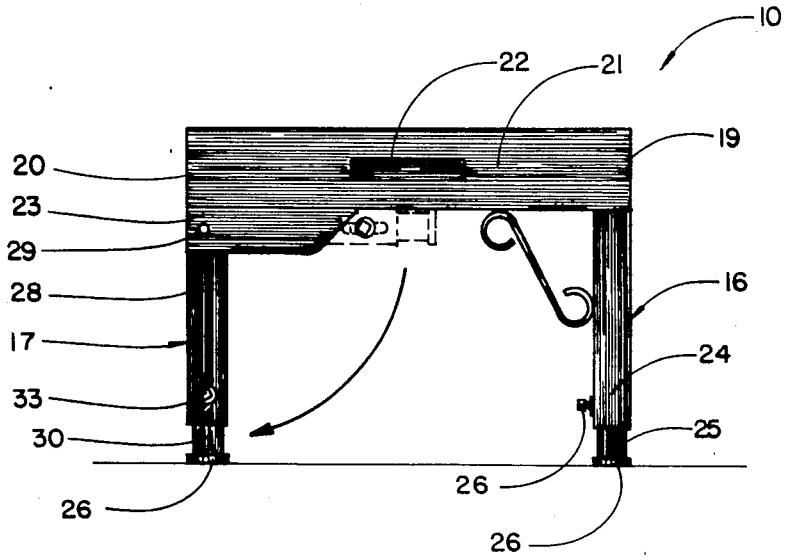
FIG. 3 is a side elevational view thereof showing the rear leg in a downward, substantially vertical position.
Figure 6:
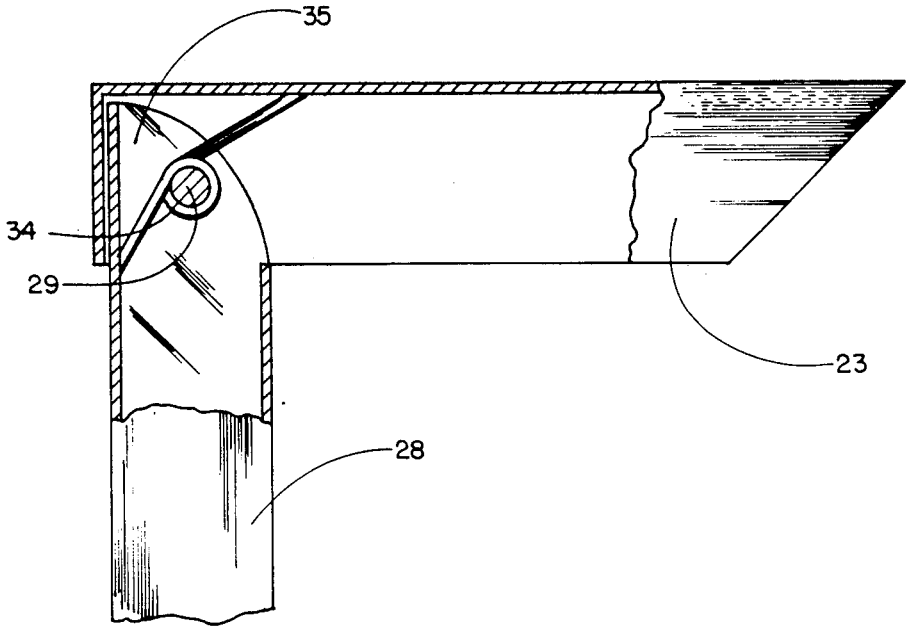
FIG. 6 is a side sectional view thereof with the rear leg in a downward, substantially vertical position.

The rear leg 17, as previously indicated, is pivotally mounted so as to be movable between a downward, substantially vertical position as shown in FIG. 3 and an upward, inoperative position as shown in FIG. 2 in which rear leg 17 is folded against the underside of ash pan 15 and extends between the walls of channel member 23. Rear leg 17 is biased to the downward position by a torsion spring 34 journaled about pivot pin 29. The movement of rear leg 17 toward the downward position is stopped when the tip 35 of upper leg portion 28 engages the top of channel member 23 as can be clearly seen in FIG. 6.

While in use, the ash catcher 10 of the present invention is positioned so that the rear wall 20 extends underneath the outwardly extending ledge 14 of the associated woodstove 11. The rear leg 17 is folded upwardly against the underside of ash pan 15 so that channel member 23 rests upon the hearth 13 of fireplace 12. It is understood that in so placing ash catcher 10, the rear leg 12 will be moved into its upward inoperative position when it engages the hearth 13 while the ash catcher is being positioned.

The ash catcher 10 allows ash and other debris to be swept from the woodstove 11 over ledge 14 and into ash pan 15 without spilling the same onto the hearth 13. When full, the ash catcher 10 can be grasped by handles 22 and carried to a remote location where the ashes are to be dumped or otherwise disposed of. When the ash catcher 10 is lifted away from hearth 13, rear leg 17 will of course be urged into its downward position enabling ash catcher 10 to be set down in freestanding fashion when not in use.

From the foregoing, it is apparent that the ash catcher 10 of the present invention provides a simple and efficient means for removing ash from a fireplace insert. The ash catcher 10 may also be used decoratively by providing the same with scroll-like ornamentation indicated at 36.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An ash catcher for use in connection with a woodstove adapted to be inserted into a fireplace, said fireplace having a raised hearth, said woodstove having an outwardly extending ledge defining an open space between said ledge and the top of said hearth, comprising: an open top pan including a bottom and a surrounding wall structure, said surrounding wall structure having a rear wall, a front wall and side walls connecting opposite ends of said front and rear walls; hearth engaging means for supporting the rear portion of said pan on said hearth such that said rear wall extends into said open space between said ledge and said hearth; a pair of legs for supporting the front portion of said pan; at least one rear leg pivotally secured to said pan and movable between a retracted position in which said rear leg is folded against the underside of said pan when said pan is in engagement with said hearth and a downward, substantially vertical position for supporting the rear portion of said pan when said pan is not in engagement with said hearth; and means for biasing said rear leg to said downward position such that when said pan is removed from said hearth said rear leg automatically assumes a downward position.

2. The ash catcher of claim 1 wherein said hearth engaging means includes a downwardly opening channel secured to the rear portion of said pan and wherein said rear leg is pivotally secured to said channel member by means of a pivot pin such that when said rear leg assumes a retracted position, the same extends between the walls of said channel.

3. The ash catcher of claim 2 wherein said biasing means incudes a torsion spring journaled about said pivot pin interiorly of said rear leg, said torsion spring having one arm bearing against the underside of said pan and one arm bearing against the interior of said rear leg.

4. The ash catcher of claim 1 wherein said front legs each include an upper leg portion fixedly secured to said pan, a lower leg portion slidingly mounted in said upper leg portion and means for fixing said lower leg portion in at least two different positions relative to said upper leg portion whereby the length of said front legs can be adjusted.

5. The ash catcher of claim 1 wherein said pan further includes a pair of U-shaped handles secured to opposite sidewalls to facilitate lifting and carrying of said ash pan.

6. An ash catcher for use in connection with a woodstove adapted to be inserted into a fireplace having a raised hearth comprising: an open top pan including a bottom and a surrounding wall structure; hearth engaging means for supporting the rear portion of said pan on said hearth and adjacent to said woodstove; a pair of legs for supporting the front portion of said pan; and at least one leg secured to said rear portion of said pan and movable between a retracted position when said pan is in engagement with said hearth and a downward, substantially vertically position for supporting said rear portion of said pan when said pan is not in engagement with said hearth; and means for biasing said rear leg to said downward position such that when said pan is removed from said hearth, said rear leg automatically assumes a downward position.

7. The ash catcher of claim 6 wherein said hearth engaging means include a downwardly opening channel secured to the rear portion of said pan and wherein said rear leg is pivotally secured to said channel member such that when said rear leg assumes a retracted position, the same extends between the walls of said channel.

8. The ash catcher of claim 6 wherein said front legs each include an upper leg portion fixedly secured to said pan, a lower leg portion slidingly mounted within said upper leg portion and means for fixing said lower leg portion in at least two different positions relative to said upper leg portion whereby the length of said front legs can be adjusted.

9. The ash catcher of claim 6 wherein said pan further includes a pair of handles secured to said surrounding wall structure to facilitate lifting and carrying of said ash pan.

* * * * *